US009989909B2

(12) United States Patent
Ishikawa

(10) Patent No.: US 9,989,909 B2
(45) Date of Patent: Jun. 5, 2018

(54) BELT DEVICE AND IMAGE FORMING APPARATUS INCORPORATING SAME

(71) Applicant: Sohichiroh Ishikawa, Tokyo (JP)

(72) Inventor: Sohichiroh Ishikawa, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days. days.

(21) Appl. No.: 15/415,155

(22) Filed: Jan. 25, 2017

(65) Prior Publication Data

US 2017/0242384 A1 Aug. 24, 2017

(30) Foreign Application Priority Data

Feb. 19, 2016 (JP) ..... 2016-030258

(51) Int. Cl.
*G03G 15/16* (2006.01)
*G03G 15/00* (2006.01)

(52) U.S. Cl.
CPC ..... *G03G 15/5054* (2013.01); *G03G 15/1605* (2013.01); *G03G 15/1615* (2013.01); *G03G 2215/0016* (2013.01); *G03G 2215/0129* (2013.01)

(58) Field of Classification Search
USPC ..... 399/38, 66, 159, 162, 165, 297, 298, 399/301–303, 308
See application file for complete search history.

(56) References Cited

U.S. PATENT DOCUMENTS 7,379,683 B2 * 5/2008 Kamiya ..... G03G 15/5008 399/301
8,417,162 B2 * 4/2013 Matsuo ..... G03G 15/0131 399/301
2011/0228355 A1 9/2011 Morita et al.

FOREIGN PATENT DOCUMENTS

JP 2013-156299 8/2013

* cited by examiner

*Primary Examiner* — Hoan Tran
(74) *Attorney, Agent, or Firm* — Oblon, McClelland, Maier & Neustadt, L.L.P.

(57) ABSTRACT

A belt device includes a belt member, a detected unit, a window, an optical detector, and a regulation member. The belt member is movable in a direction of belt movement. The detected unit disposed on at least one side of the belt in a width direction of the belt intersecting with the direction of belt movement and extending in the direction of belt movement. The window transmits detection light emitted toward the detected unit and reflected light from the detected unit. The optical detector detects the detected unit. The regulation member is disposed on at least one side in a width direction of the window to keep the detected unit away from the window.

20 Claims, 11 Drawing Sheets

BELT DEVICE AND IMAGE FORMING APPARATUS INCORPORATING SAME

CROSS-REFERENCE TO RELATED APPLICATION

This patent application is based on and claims priority pursuant to 35 U.S.C. § 119 to Japanese Patent Application No. 2016-030258, filed on Feb. 19, 2016, in the Japan Patent Office, the entire disclosure of which is hereby incorporated by reference herein.

BACKGROUND

Technical Field

Exemplary aspects of the present disclosure relate to a belt device and an image forming apparatus incorporating the belt device.

Related Art

Image forming apparatuses include a belt device such as a transfer unit as a transfer member and a conveyance unit as a conveyance member. The belt device includes an endless belt member looped around a plurality of supporting members such as rollers. Such a belt device may include a tape-like detected unit to be read by an optical detector so that a conveyance speed of the belt member is controlled. The detected unit is attached on at least one side of the belt member in a belt width direction perpendicular to a belt movement direction and across a longitudinal direction (a length direction) of the belt member. The tape-like detected unit is also called a scale tape, and has slits or roughness. The detected unit reflects detection light emitted from the optical detector, so that the optical detector receives the reflected light from the detected unit to detect the slits or roughness of the detected unit.

SUMMARY

In at least one embodiment of this disclosure, there is provided a novel belt device that includes a belt member, a detected unit, a window, an optical detector, and a regulation member. The belt member is movable in a direction of belt movement. The detected unit disposed on at least one side of the belt in a width direction of the belt intersecting with the direction of belt movement and extending in the direction of belt movement. The window transmits detection light emitted toward the detected unit and reflected light from the detected unit. The optical detector detects the detected unit. The regulation member is disposed on at least one side in a width direction of the window to keep the detected unit away from the window.

Further provided is an improved image forming apparatus incorporating the belt device described above.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
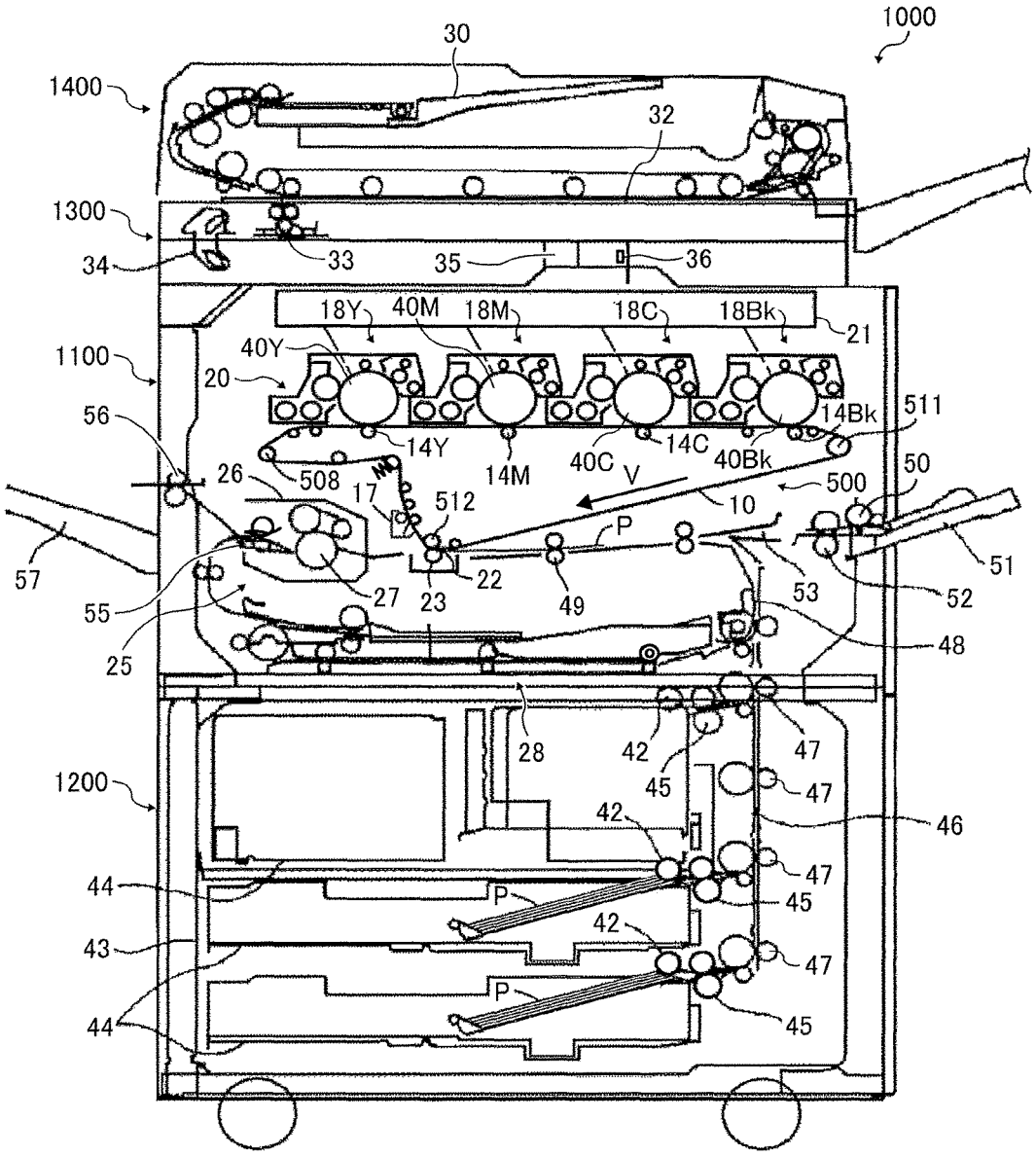
FIG. 1 is a schematic diagram illustrating an image forming apparatus including a belt device according to an exemplary embodiment.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner and achieve similar results.

Although the exemplary embodiments are described with technical limitations with reference to the attached drawings, such description is not intended to limit the scope of the disclosure and all of the components or elements described in the exemplary embodiments of this disclosure are not necessarily indispensable.

Referring now to the drawings, exemplary embodiments of the present disclosure are described below. In the drawings for explaining the following exemplary embodiments, the same reference codes are allocated to elements (members or components) having the same function or shape and redundant descriptions thereof are omitted below.

In the drawings, a configuration of the component or element may be partially omitted to describe one portion of the configuration. A belt device of an exemplary embodiment includes a belt member, a detected unit, a window, an optical detector, and a regulation member. The belt member is movable in a direction of belt movement. The detected unit is disposed toward a belt longitudinal direction on at least one side of the belt member in a belt width direction intersecting with the direction of belt movement. The window transmits detection light emitted toward the detected unit and reflected light from the detected unit. The optical detector detects the detected unit. The regulation member is disposed on at least one side in a width direction of the window to keep the detected unit away from the window. Accordingly, a space having a height of the regulation member is formed between the window and the detected unit. Such a space prevents contact between the window and the detected unit, thereby preventing a reading failure in the optical detector detecting the detected unit disposed on the belt member.

First, a configuration of an image forming apparatus including a belt device according to the exemplary embodiment is described. Then, a configuration of the belt device is described.

FIG. 1 illustrates an electrophotographic color copier 1000 as an image forming apparatus according to the exemplary embodiment. The color copier 1000 includes a copier body 1100 as an apparatus body of the image forming apparatus, a sheet feed table 1200 on which the copier body 1100 is placed, a scanner 1300 as an image reader attached on the copier body 1100, and an automatic document feeder (ADF) 1400 attached on the scanner 1300. The copier body 1100 includes a transfer unit 500 as a belt device including a transfer belt 10 as an intermediate transfer member of an endless belt member. The transfer unit 500 is disposed in a center portion of the copier body 1100. The transfer belt 10 is looped around a plurality of rollers as supporting members, and can move in a clockwise direction indicated by an arrow V (hereinafter referred to as "a belt movement direction V") illustrated in FIG. 1. A transfer cleaner 17 is disposed near the transfer belt 10 to remove residual toner remaining on the transfer belt 10 subsequent to transfer of an image. Moreover, in FIG. 1, four process cartridges 18Bk, 18C, 18M, and 18Y for black, cyan, magenta, and yellow are aligned above the transfer unit 500 and along the belt movement direction V. The process cartridges 18Bk, 18C, 18M, and 18Y form a tandem image forming unit 20, and an exposure device 21 is disposed above the tandem image forming unit 20. The process cartridges 18Bk, 18C, 18M, and 18Y respectively include drum-shaped photoconductors 40Bk, 40C, 40M, and 40Y as image bearers. The process cartridges 18Bk, 18C, 18M, and 18Y form toner images on the respective photoconductors 40Bk, 40C, 40M, and 40Y with toner as developer of respective colors by using a known electrophotographic functional member. The process cartridges 18Bk, 18C, 18M, and 18Y also have functions of cleaning surfaces of the respective photoconductors 40Bk, 40C, 40M, and 40Y subsequent to transfer of the toner images. Each of the process cartridges 18Bk, 18C, 18M, and 18Y and the transfer unit 500 is detachably supported by the copier body 1100.

A secondary transfer roller 23 as a secondary transfer rotator is disposed at a side opposite the tandem image forming unit 20 with the transfer belt 10 therebetween. The secondary transfer roller 23 is a supporting member for supporting the transfer belt 10 from outer side, and is pressed against a secondary transfer counter roller 512 as a secondary transfer counter rotator via the transfer belt 10 to form a secondary transfer portion (a nip portion) 22 in a contact area between the transfer roller 23 and the secondary transfer counter roller 512. In the secondary transfer portion 22, transfer bias is applied to the secondary transfer counter roller 512 or the secondary transfer roller 23. Such application of the transfer bias transfers a toner image or a combined color image on the transfer belt 10 to a sheet P as a recording medium.

A fixing device 25 for fixing the toner image transferred to the sheet P is disposed on a downstream side of the secondary transfer roller 23 in a sheet conveyance direction. The fixing device 25 includes a pressure roller 27 and a fixing belt 26 that is a belt member. The fixing device 25 presses the pressure roller 27 as a pressing rotator against the fixing belt 26 as a fixing rotator. In addition to the secondary transfer counter roller 512, an endless belt looped around a plurality of rollers may be used as the secondary transfer counter rotator. In the exemplary embodiment, a contact method by which the secondary transfer roller 23 as a secondary transfer member contacts the transfer belt 10 is employed. However, a non-contact charger may be disposed as the secondary transfer member. In such a case, since the roller member or the belt member has a difficulty in having a sheet conveyance function, a conveyance unit can be disposed separately.

In FIG. 1, a sheet reverse unit 28 for reversing a sheet P when images are recorded on two sides of the sheet P is disposed below the secondary transfer portion 22 and the fixing device 25 and parallel to the tandem image forming unit 20, so that duplex printing can be performed. In a case where the color copier 1000 performs only single-sided printing, the sheet reverse unit 28 may not necessarily be disposed. The color copier 1000 can be connected to an external terminal device such as a personal computer (PC) in a wired or wireless manner to function as a printer. The image forming apparatus is not limited to a color copier and a printer. The image forming apparatus can be a facsimile, or a multifunctional peripheral having two or more copying, printing, and facsimile functions.

When a user uses such a configuration of the color copier 1000 to make a color copy, the user sets a color document on a document tray 30 of the ADF 1400. Alternatively, the user can open the ADF 1400 to set a color document on a contact glass 32 of the scanner 1300, and close the ADF 1400 to press down the color document. Then, the user turns on a start button of the color copier 1000. If the document is set on the ADF 1400, the color copier 1000 conveys the document to the contact glass 32, and then drives the scanner 1300 to activate a first travelling body 33 and a second travelling body 34. If the document is set on the contact glass 32, the color copier 1000 promptly drives the scanner 1300 to activate the first travelling body 33 and the second travelling body 34. In the color copier 1000, the first travelling body 33 not only allows light to be emitted from a light source, but also reflects reflected light from a document surface toward the second travelling body 34. The reflected light reflects off a mirror of the second travelling body 34, and then enters a reading sensor 36 via an imaging lens 35. Accordingly, the document is read.

When the start button is turned on, the transfer belt 10 is rotated clockwise by a drive motor as a drive unit. At the same time, the photoconductors 40Bk, 40C, 40M, and 40Y of the respective process cartridges 18Bk, 18C, 18M, and 18Y are rotated, so that toner images of the respective colors of black, cyan, magenta, and yellow are formed on the photoconductors 40Bk, 40C, 40M, and 40Y. In the color copier 1000, the single-color images are sequentially transferred to the transfer belt 10 while the transfer belt 10 is moving, thereby forming combined color images on the transfer belt 10.

When the start button is turned on, the color copier 1000 selects and rotates one of sheet feeding rollers 42 to feed sheets P from of one of a plurality of sheet feed cassettes 44 in a sheet bank 43. The sheets P fed from the sheet feed cassette 44 are separated one by one by a separation roller 45, and the separated sheet P is conveyed to a sheet feed path 46. The sheet P is further conveyed by a conveyance roller 47 and guided to a sheet feed path 48 inside the copier body 1100. When the sheet P contacts a registration roller 49, the conveyance of the sheet P temporarily stops. Alternatively, sheets P on a manual tray 51 may be fed. In such a case, the color copier 1000 rotates a sheet feed roller 50 to feed the sheets P on the manual tray 51. The sheets P fed from the manual tray 51 are separated one by one by a separation roller 52, and the separated sheet P is conveyed to a manual sheet feed path 53. When the sheet P contacts the registration roller 49, the conveyance of the sheet P temporarily stops as similar to the sheet P fed from the sheet feed cassette 44. When the registration roller 49 is rotated to time with arrival of the combined color images on the transfer belt 10 at the secondary transfer portion 22, the sheet P is fed to the secondary transfer portion 22 between the transfer belt 10 and the secondary transfer roller 23. In the secondary transfer portion 22, the combined color images are collectively transfer to the sheet P. In a case where a single-color copy needs to be made, a single-color toner image is formed and then transferred to the transfer belt 10. The single-color toner image on the transfer belt 10 is transferred to a sheet P in the secondary transfer portion 22.

The sheet P with the transferred toner image is conveyed from the secondary transfer portion 22 to the fixing device 25. After the fixing device 25 fixes the toner image on the sheet P by applying heat and pressure, a switching pawl 55 switches a conveyance direction of the sheet P to an ejection roller 56. Then, the sheet P is ejected and stacked on a sheet ejection tray 57 by the ejection roller 56. Alternatively, the switching pawl 55 may switch a conveyance direction of the sheet P with the transferred toner image to the sheet reverse unit 28. In such a case, the sheet P is reversed by the sheet reverse unit 28, and the reversed sheet P is guided to the secondary transfer portion 22 again. After an image is transferred to a back surface of the sheet P, the ejection roller 56 ejects the sheet P to the sheet ejection tray 57. The transfer cleaner 17 removes residual toner remaining on the transfer belt 10 subsequent to the transfer of the image, and the transfer belt 10 becomes ready for next image formation, which is performed by the tandem image forming unit 20.

In the exemplary embodiment, the transfer belt 10 has a single layer or a multi-layer made of a material such as polyvinylidene difluoride (PVDF), ethylene tetrafluoroethylene (ETFE), polyimide (PI), and polycarbonate (PC). A surface of the transfer belt 10 can be coated with a release layer as necessary. Moreover, an elastic belt having a rubber layer may be used as the transfer belt 10. Since the elastic belt as the transfer belt 10 can be deformed, the use of the elastic belt enables clearance generated by a sheet P having roughness to be filled in the secondary transfer portion 22. Hence, the use of the elastic belt can provide good transferability. In a case where the elastic belt including only a rubber layer is employed, the belt can be excessively stretched. Thus, the transfer belt 10 may have a resin layer such as a polyimide layer (PI layer) in a base layer. Moreover, the transfer belt 10 may have a layer having a low friction coefficient in a surface layer.

Next, the transfer unit 500 is described in detail.

Figure 2:
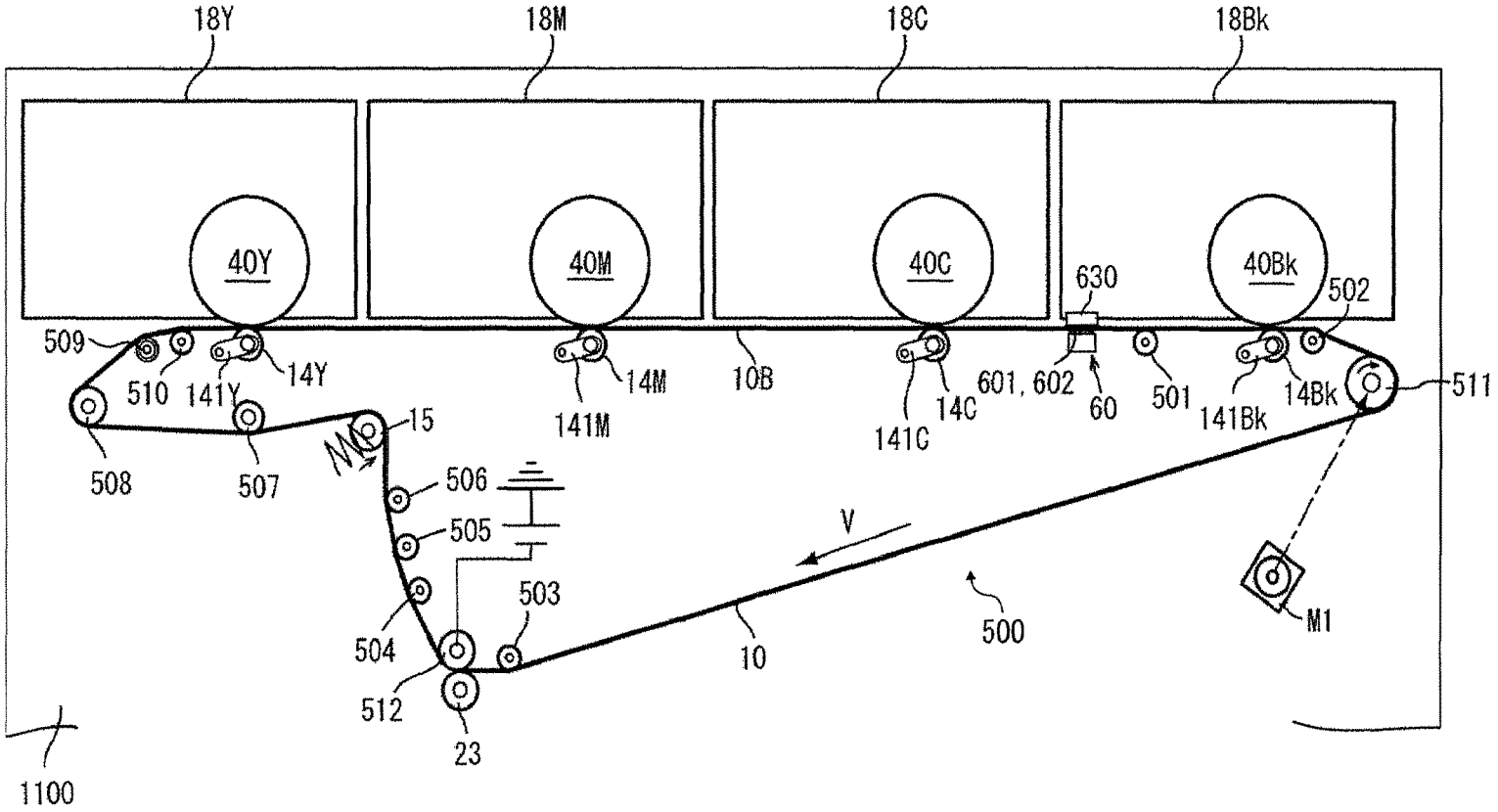
FIG. 2 is an enlarged view illustrating a configuration of a transfer unit as the belt device.

FIG. 2 is a schematic diagram illustrating the process cartridges 18Bk, 18C, 18M, and 18Y and the transfer unit 500 as seen from a front side of the copier body 1100. The transfer unit 500 includes first through eleventh rollers 501 through 511 as a plurality of supporting members, the secondary transfer counter roller 512 as a supporting member, and the transfer belt 10 looped around the rollers 501 through 512. The rollers 501 through 511 are rotatably supported by a component such as a side plate of the transfer unit 500. In FIG. 2, the roller 511 and the roller 508 are respectively arranged on the far-right side and the far-left side of the copier body 1100. In the exemplary embodiment, the roller 511 serves as a drive roller, whereas each of the rollers 501 through 510 serves as a driven roller. In FIG. 2, the roller 511 is rotated clockwise by a drive motor M1 as a drive source. The rotation of the roller 511 moves the transfer belt 10 at a predetermined speed. A tension roller 15 as a supporting member and a tension application rotator is disposed between the rollers 506 and 507. The tension roller 15 applies tension to the transfer belt 10 by urging the transfer belt 10 toward a belt inner side. The tension roller 15 is constructed as an elastic roller including a metal core and a rubber layer around the metal core.

The transfer belt 10 is disposed opposite the photoconductors 40Bk, 40C, 40M, and 40Y of the respective process cartridges 18Bk, 18C, 18M, and 18Y on the upper side of the transfer belt 10 looped between the rollers 511 and 508. The secondary transfer counter roller 512 is a rubber roller including a metal core and a rubber layer around the metal core, and a secondary transfer bias is applied to the metal core. In the exemplary embodiment, the application of the secondary transfer bias is performed such that a voltage with current that is maintained constant is applied.

On the upper side of the transfer belt 10 in FIG. 2, primary transfer rollers 14Bk, 14C, 14M, and 14Y as primary transfer rotators are arranged on an inner side of the transfer belt 10 and opposite the respective photoconductors 40Bk, 40C, 40M, and 40Y. The primary transfer rollers 14Bk, 14C, 14M, and 14Y are rotatably supported by respective supporting arms 141Bk, 141C, 141M, and 141Y that are known contact-separation mechanisms. Each of the supporting arms 141Bk, 141C, 141M, and 141Y vertically swings in FIG. 2. An electric actuator or a cam adjusts an angle of each of the supporting arms 141Bk, 141C, 141M, and 141Y, so that the supporting arms 141Bk, 141C, 141M, and 141Y contact and separate from the transfer belt 10. Each of the primary transfer rollers 14Bk, 14C, 14M, and 14Y is a rubber roller including a metal core and a rubber layer around the metal core, and a primary transfer bias is applied to each of the metal cores. In the exemplary embodiment, the application of the primary transfer bias is performed such that a voltage with current that is maintained constant is applied.

Figure 3:
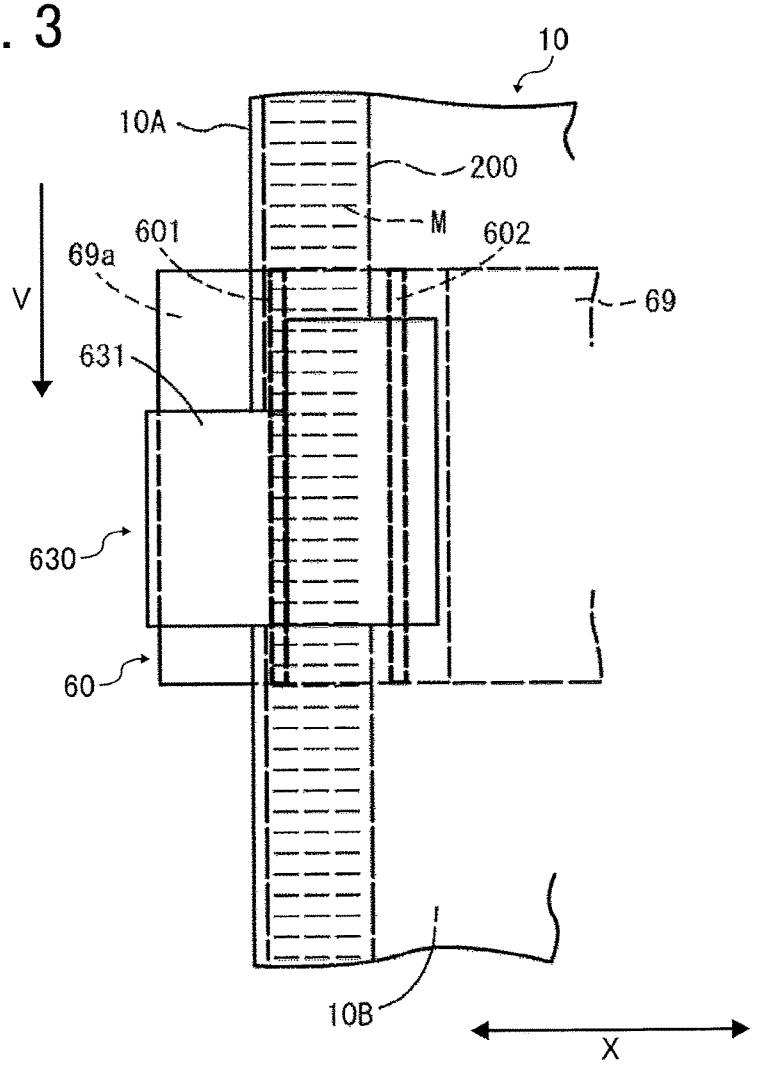
FIG. 3 is an enlarged view illustrating arrangement of an optical detector and a tape-like detected unit on an edge portion of a belt member.

As illustrated in FIG. 3, the transfer belt 10 includes a scale tape 200 as a detected unit across a longitudinal direction of the transfer belt 10. The scale tape 200 is disposed in at least an end portion 10A that is one end portion in a belt width direction X intersecting with the belt movement direction V and on an inner surface 10B that is a side opposite each of the rollers. The scale tape 200 is disposed in at least one side portion of the belt in the belt width direction X intersecting with the belt movement direction V, and extends in the belt movement direction X.

Figure 4:
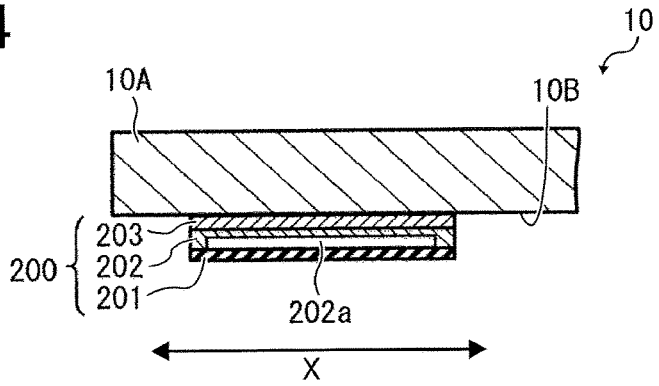
FIG. 4 is an enlarged sectional view illustrating one example of the detected unit disposed on the belt member.

The scale tape 200 includes three layers of a protective layer 201 having an insulation property, a conductive metal layer 202, and an adhesive layer 203 that are laminated as illustrated in FIG. 4. The scale tape 200 is attached to the inner surface 10B of the transfer belt 10 by an adhesive force of the adhesive layer 203. That is, the scale tape 200 is integrated with the transfer belt 10. The conductive metal layer 202 is a metal deposition film formed by depositing a conductive metal such as aluminum on an insulation film made of, for example, polyethylene terephthalate (PET) having an insulation property which is retained by the protective layer 201. In FIG. 4, each of the layers 201 through 203 is exaggerated for the sake of illustration of the scale tape 200. The scale tape 200 has a roughness portion 202*a*. For example, when a process laser beam is emitted by a laser beam machine to the metal layer 202 from a protective layer 201 side, the metal layer 202 is partially melted by the laser beam and thus the roughness portion 202*a* is formed. The scale tape 200 as a detected unit is disposed along the belt movement direction V. A plurality of scale marks M has a predetermined pitch between scale marks adjacent to each other.

Figure 5:
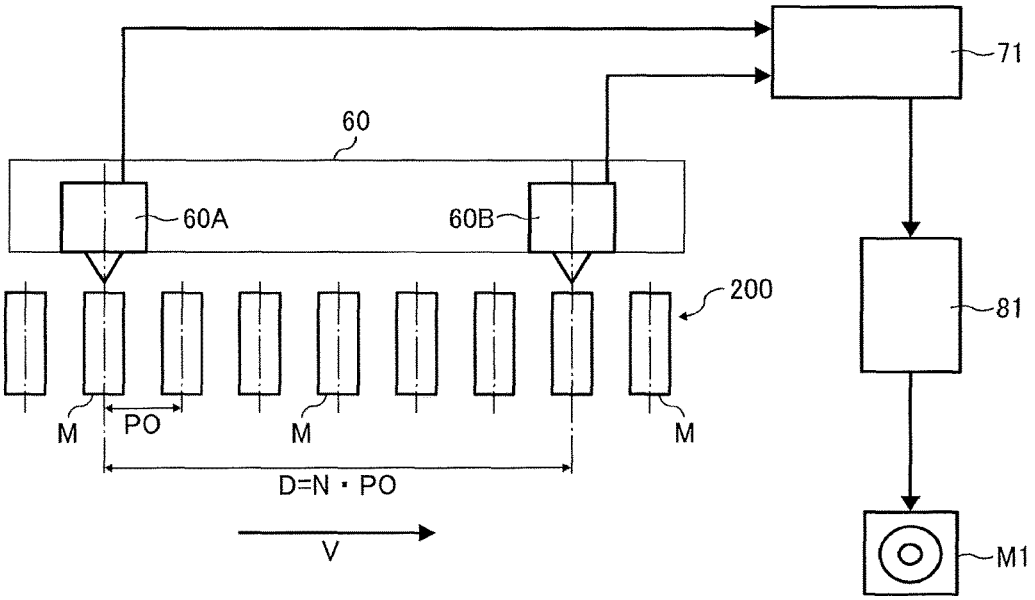
FIG. 5 is a diagram illustrating arrangement of the optical detector for detecting the detected unit and a configuration of a control system for the detection.

As illustrated in FIG. 5, the roughness portions 202*a* each having the substantially the same length are not only arranged parallel to and equidistant from each other, but also arranged with a small pitch along the belt movement direction V. Such arrangement is provided on the entire circumference in the belt movement direction V of the transfer belt 10, so that scale marks M are formed as a detection area to be read by an optical detector. In the exemplary embodiment, the scale tape 200 is attached to the inner surface 10B of the transfer belt 10, but is not limited to the attachment. For example, a scale mark M may be directly formed on the inner surface 10B of the transfer belt 10 by a laser beam machine. In the exemplary embodiment, the scale tape 200 is disposed on the entire circumference of the transfer belt 10. However, the scale tape 200 may be disposed on one portion in a movement direction of the transfer belt 10.

In FIG. 5, scale mark sensors 60A and 60B (hereinafter called scale sensors 60A and 60B) as optical detectors are arranged opposite the scale marks M. Each of the scale sensors 60A and 60B is connected to a drive controller 71 via a signal wire. The scale sensors 60A and 60B are spaced a certain distance apart along the belt movement direction V of the transfer belt 10. Each of the scale sensors 60A and 60B successively detects the scale marks M on the transfer belt 10, and outputs detection signals to the drive controller 71. In the exemplary embodiment, the two scale sensors 60A and 60B function as one optical detector 60. However, alternatively, either of the scale sensors 60A and 60B may be used to detect the scale marks M on the scale tape 200. The drive controller 71 is connected to the drive motor M1 via a motor drive circuit 81, and has a function of controlling drive of the drive motor M1 to control a belt movement speed of the transfer belt 10. The drive controller 71 acquires position data used for pitch correction of the scale marks M based on the detection signals from the scale sensors 60A and 60B, and inputs target position data to the motor drive circuit 81, thereby controlling the belt movement speed of the transfer belt 10. Accordingly, the drive controller 71 outputs a signal as necessary to the motor drive circuit 81 based on the position information of the transfer belt 10 detected by the scale sensors 60A and 60B to allow the motor drive circuit 81 to drive the drive motor M1, thereby performing feedback control of the belt movement speed of the transfer belt 10.

The scale sensors 60A and 60B are respectively arranged on an upstream side and a downstream side of the transfer belt 10 in the belt movement direction V. With the drive controller 71, the each of the scale sensors 60A and 60B can detect all of the scale marks M. Moreover, a distance D between points detected by the respective scale sensors 60A and 60B is set to an integral multiplication of P0, that is, D=N×P0 (N=1, 2, 3, . . . ), where P0 is a setting value of pitch of the scale marks M. If there is no expansion or contraction of the transfer belt 10, the scale sensors 60A and 60B simultaneously pass the center of the scale marks M. When the transfer belt 10 moves, each of the scale sensors 60A and 60B successively detects the scale marks M and outputs detection signals to the drive controller 71. Accordingly, the drive controller 71 performs feedback controls of the motor drive circuit 81 based on a phase difference of the detection signals (input signals).

Figure 6A:
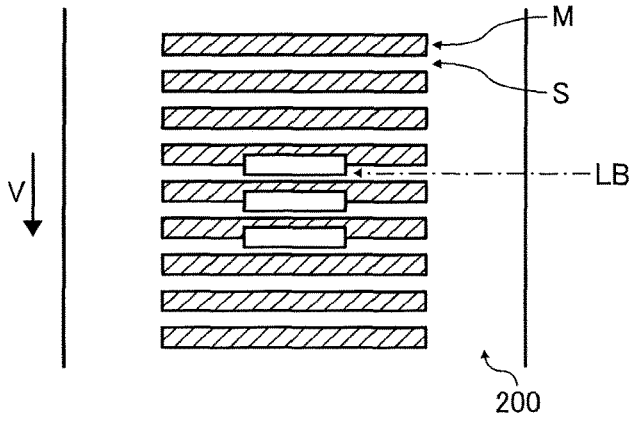
FIGS. 6A, 6B, and 6C are diagrams illustrating a configuration of the optical detector.
Figure 6B:
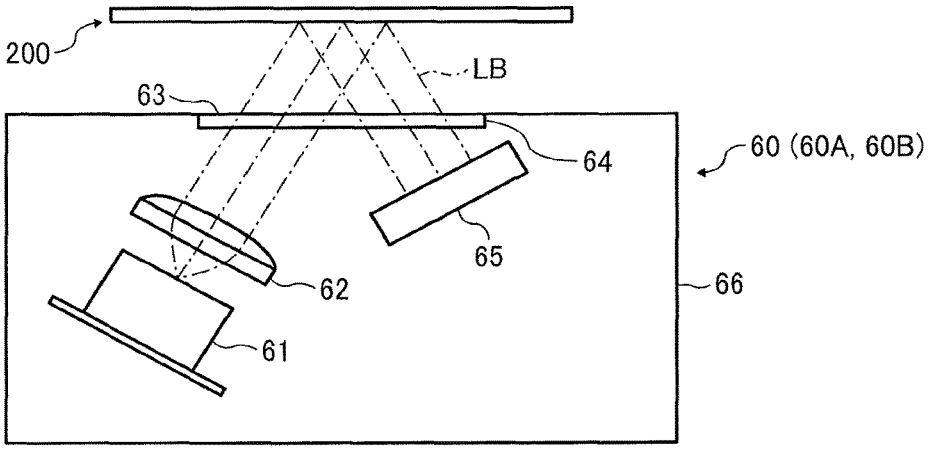
Figure 6C:
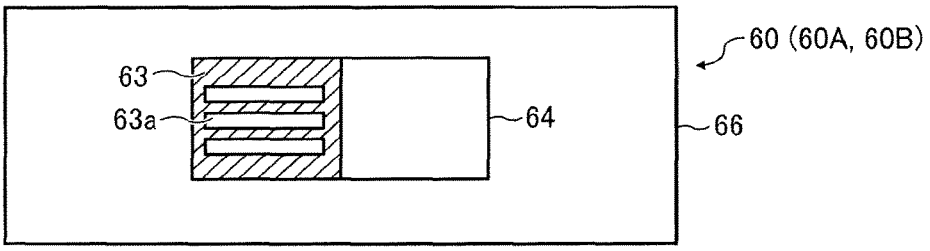

Detection of the scale marks M by the scale sensors 60A and 60B is described with reference to FIGS. 6A, 6B, and 6C. Since the scale sensors 60A and 60B have substantially the same configuration, the same reference numerals are allocated to elements (members or components) having the same function. FIG. 6A is a plan view of the scale marks M on the scale tape 200. FIG. 6B is a perspective side view of an optical system and an optical path of the scale sensors 60A and 60B, and FIG. 6C is a plan view of a detection surface of the scale sensors 60A and 60B. The scale mark M is a reflective mark. The scale mark M as a reflection area and a light-shielding area S are alternately formed along the belt movement direction V on the inner surface 10B of the transfer belt 10. Each of the scale sensors 60A and 60B includes a light emitting element 61 such as a light emitting diode (LED), a collimate lens 62, a slit mask 63, a window 64 including a transparent cover such as a glass cover and a transparent resin film, and a light receiving element 65 such as a phototransistor. Each of the units 61 through 65 is attached to a casing 66 as a sensor holder. When the light emitting element 61 as a light source of each of the scale sensors 60A and 60B emits light, the light passes the collimate lens 62 to provide parallel light flux. The parallel light flux passes a plurality of slits 63*a* of the slit mask 63, the slits 63*a* being parallel to the scale marks M. After passing the slits 63*a*, the parallel light flux is split into a plurality of optical beams LB. Then, the scale tape 200 on the transfer belt 10 is irradiated with the optical beams LB. The scale marks M reflect one portion of the plurality of optical beams LB, and the reflected beam is received by the light receiving element 65 via the window 64. The light receiving element 65 converts a change in intensity (light and darkness) of the reflected light into an electric signal. Accordingly, each of the scale sensors 60A and 60B detects a change in intensity of the reflected light by using the light receiving element 65 to detect the scale mark M, and converts the present or absence of the scale mark M with the movement of the transfer belt 10 into analog alternating signals that are continuously modulated. Then, each of the scale sensors 60A and 60B outputs the analog alternating signals.

To further an understanding of the present disclosure, a description is now given of comparative examples.

Figure 7:
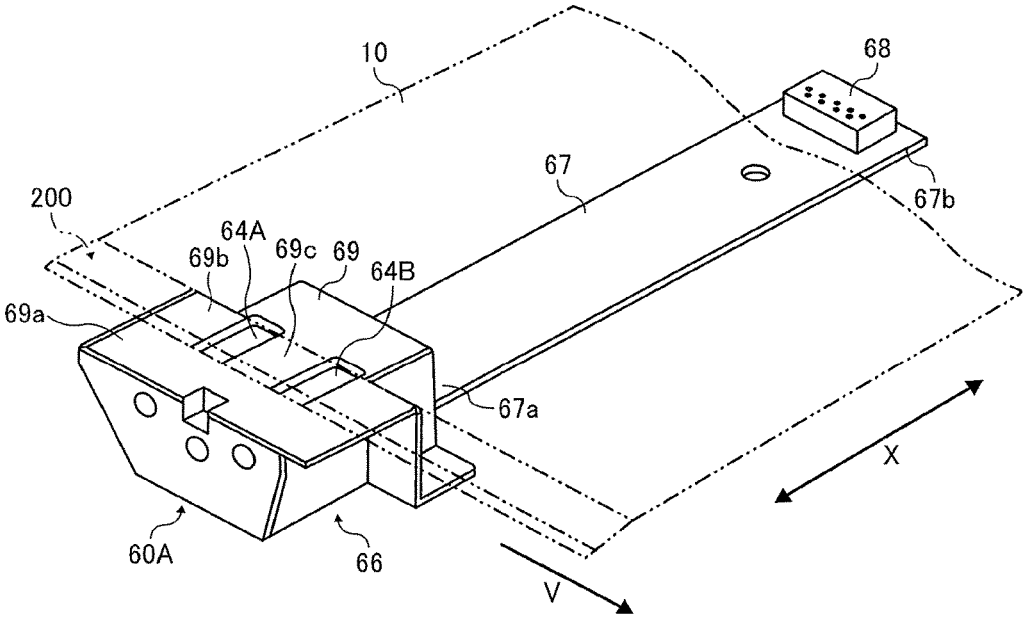
FIG. 7 is a perspective view illustrating a configuration of a comparative example of the optical detector.
Figure 8:
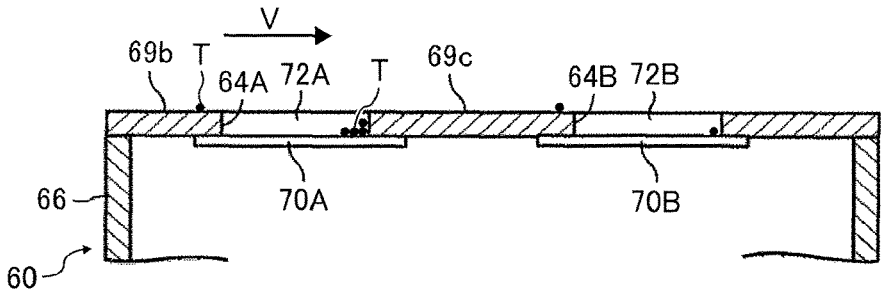
FIG. 8 is a partial sectional view illustrating a configuration near a window of the optical detector illustrated in FIG. 7.

FIG. 7 is a perspective view illustrating a configuration of the optical detector. In the comparative example illustrated in FIG. 7, the optical detector 60 with the scale sensors 60A and 60B includes the casing 66 attached to one end portion 67*a* of a sensor substrate 67 extending in a belt width direction X, and a connector 68 disposed on the other end portion 67*b* of the sensor substrate 67. Each of the light emitting element 61 and the light receiving element 65 inside the casing 66 is connected to the connector 68 via a signal wire. The optical detector 60 is communicably connected to the drive controller 71 via the connector 68. The optical detector 60 is disposed on the inner side of the transfer belt 10, and windows 64A and 64B of the respective scale sensors 60A and 60B are arranged opposite the scale tape 200. An upper portion of the casing 66 has an opening as illustrated in FIG. 8, and a bracket 69 having a light shielding property is attached to bridge the casing 66 and the sensor substrate 67 such that the opening is covered. The windows 64A and 64B are spaced apart in the belt movement direction V, and are opened by a guide surface 69*a* as an upper surface of the bracket 69. The windows 64A and 64B are respectively closed by light transmittance members 70A and 70B such as glass members that are attached on the inner side of the bracket 69. The attachment of the light transmittance members 70A and 70B prevents foreign substances from entering the casing 66. The window 64A is formed on an upstream side of the guide surface 69*a* in the belt movement direction V, whereas the window 64B is formed on a downstream side of the guide surface 69*a* in the belt movement direction V relative to the window 64A. The window 64A transmits detection light emitted from the scale sensor 60A toward the scale tape 200 and reflected light from the scale tape 200, whereas the window 64B transmits light emitted from the scale sensor 60B toward the scale tape 200 and reflected light from the scale tape 200.

Figure 9A:
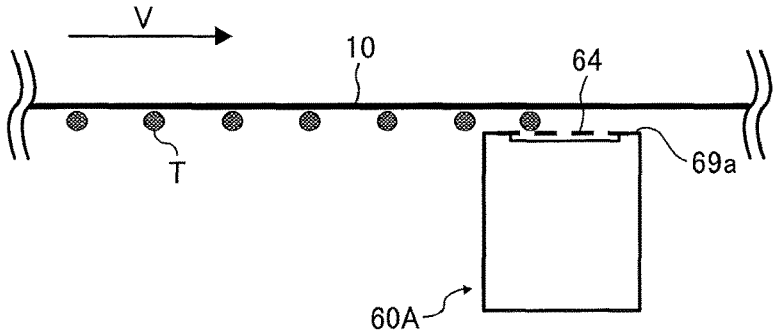
FIGS. 9A and 9B are diagrams illustrating a drawback of the optical detector illustrated in FIG. 7.
Figure 9B:
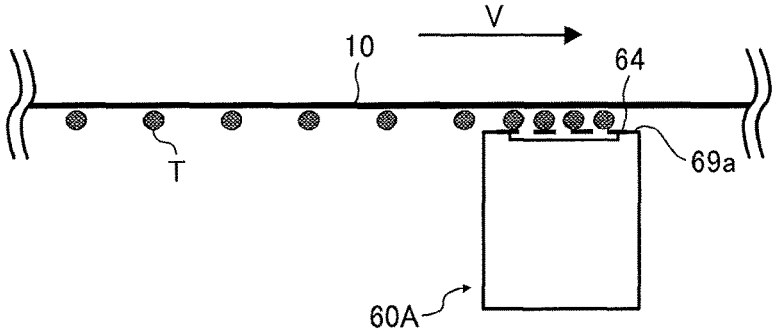

Accordingly, the scale sensors 60A and 60B include the respective windows 64A and 64B arranged opposite the transfer belt 10, which moves in the belt movement direction V. Thus, as illustrated in FIGS. 7, 9A, and 9B, when the transfer belt 10 vibrates in a vertical direction intersecting with the belt movement direction V with the movement, the transfer belt 10 can contact a component such as the windows 64A and 64B and the guide surface 69*a*. In some instances, adherents T such as toner and floating paper powder may be present on the transfer belt 10. In such a case, the vibration of the transfer belt 10 causes the adherents T to fall. The adherents T can directly fall into recessed areas 72A and 72B.

As illustrated in FIG. 8, the recessed area 72A is formed by the window 64A and the light transmittance member 70A, and the recessed area 72B is formed by the window 64B and by the light transmittance member 70B. Moreover, the adherents T can fall to the guide surface 69*a*. The recessed areas 72A and 72B are recessed toward a direction away from the scale tape 200 relative to the guide surface 69*a*. Since the windows 64A and 64B are spaced apart in the belt movement direction V, the adherents T, which have fallen, can be accumulated in upstream side areas 69*b* and 69*c* of the guide surface 69*a*. The upstream side areas 69*b* and 69*c* are provided on an upstream side of the respective windows 64A and 64B in the belt movement direction V. With the movement of the transfer belt 10, such adherents T on the guide surface 69*a* (the upstream side areas 69*b* and 69*c*) move toward the downstream side from the upstream side in the belt movement direction V, and fall to the recessed areas 72A and 72B. Hence, the adherents T are accumulated in the recessed areas 72A and 72B over time. The accumulation of the adherents T in the windows 64A and 64B blocks detection light from the scale sensors 60A and 60B and reflected light, causing a reading failure. As a result, an instruction value for speed control may become inappropriate.

Hence, in the exemplary embodiment, as illustrated in FIGS. 10A, 10B, 11, and 12, guide rails 601 and 602 as regulation members are arranged on both sides in a width direction of the windows 64A and 64B formed on the guide surface 69*a*. With the guide rails 601 and 602, the windows 64A and 64B or the guide surface 69*a* and the scale tape 200 (the inner surface 10B of the transfer belt 10) are kept separate. The term "width direction of the windows 64A and 64B" used in the exemplary embodiment indicates a direction substantially the same as the belt movement direction V. The guide rails 601 and 602 are respectively arranged on portions 69*d* and 69*e* of the guide surface 69*a* in the width direction of the windows 64A and 64B.

Figure 11:
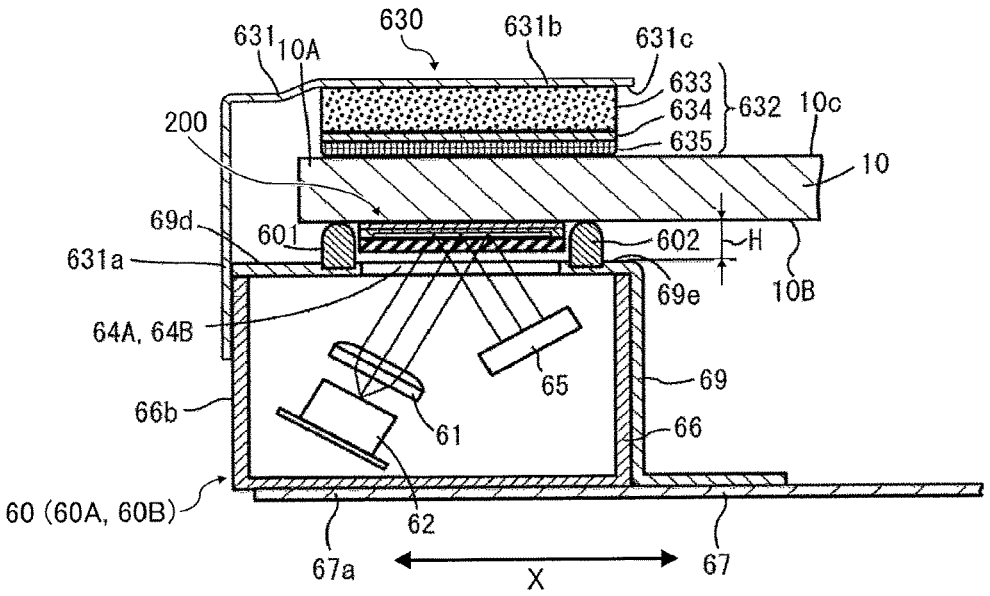
FIG. 11 is an enlarged sectional view illustrating the configuration of the pressing member and the optical detector according to the exemplary embodiment.
Figure 12:
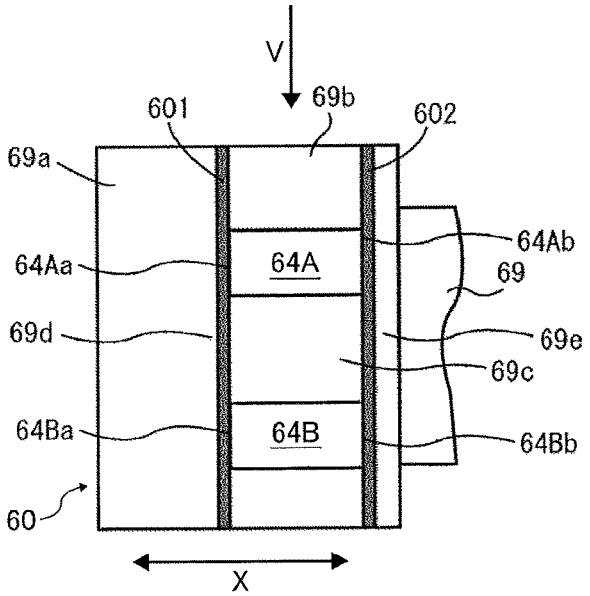
FIG. 12 is a plan view illustrating the configuration near the window of the optical detector.

As illustrated in FIG. 12, the guide rails 601 and 602 extend parallel to each other in the belt movement direction V, and are arranged across the width of the guide surface 69*a* in the belt movement direction V. The guide rail 601 is disposed along edge areas 64Aa and 64Ba positioned in the width direction of the windows 64A and 64B, whereas the guide rail 602 is disposed along edge areas 64Ab and 64Bb positioned in the width direction of the windows 64A and 64B. Each of the guide rails 601 and 602 is molded from a resin material, and projects toward the scale tape 200 (the inner surface 10B of the transfer belt 10) relative to the guide surface 69*a* as illustrated in FIG. 11. In the exemplary embodiment, each of the guide rails 601 and 602 is attached to the guide surface 69*a* by being engaged with or inserted into a groove formed on the guide surface 69*a*.

Figure 13:
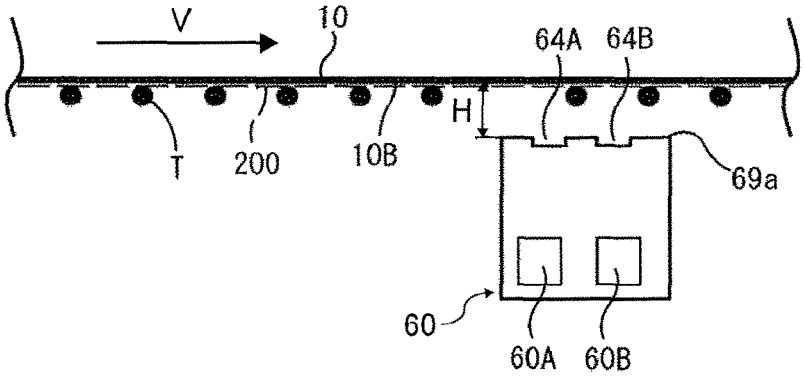
FIG. 13 is a diagram illustrating an effect of the optical detector according to the exemplary embodiment.

Accordingly, the guide rails 601 and 602 as regulation members for maintaining the windows 64A and 64B and the scale tape 200 (the guide surface 69*a* and the inner surface 10B of the transfer belt 10) in a non-contact state are arranged on the both sides of the windows 64A and 64B of the scale sensors 60A and 60B for detecting the scale tape 200 attached on the transfer belt 10. Moreover, a space having a height H is formed between the scale tape 200 and the windows 64A and 64B (between the inner surface 10B of the transfer belt 10 and the guide surface 69*a*). The height H is substantially the same as a height (projection) of each of the guide rails 601 and 602. Therefore, such arrangement can prevent not only a case in which the windows 64A and 64B contact the scale tape 200 (the guide surface 69*a* contacts the inner surface 10B of the transfer belt 10) as illustrated in FIG. 13, but also a fall of the adherents T or conveyance of the adherents T subsequent to the fall. Hence, a reading failure in the scale sensors 60A and 60B for detecting the scale tape 200 can be prevented. Moreover, the prevention of the reading failure in the scale sensors 60A and 60B can eliminate an inappropriate instruction value for speed control of the transfer belt 10. Thus, the speed of the transfer belt 10 can be stably controlled, thereby obtaining a good image. In the exemplary embodiment, the height H (projection) of each of the guide rails 601 and 602 is set to 1 mm. Moreover, the guide rails 601 and 602 extend in the belt movement direction V to cover the entire area of the guide surface 69*a* along the belt movement direction V. Such arrangement can prevent not only the adherents T from entering from the width direction of the windows 64A and 64B, but also the adherents T from being accumulated in the upstream side areas 69*b* and 69*c*.

Figure 10A:
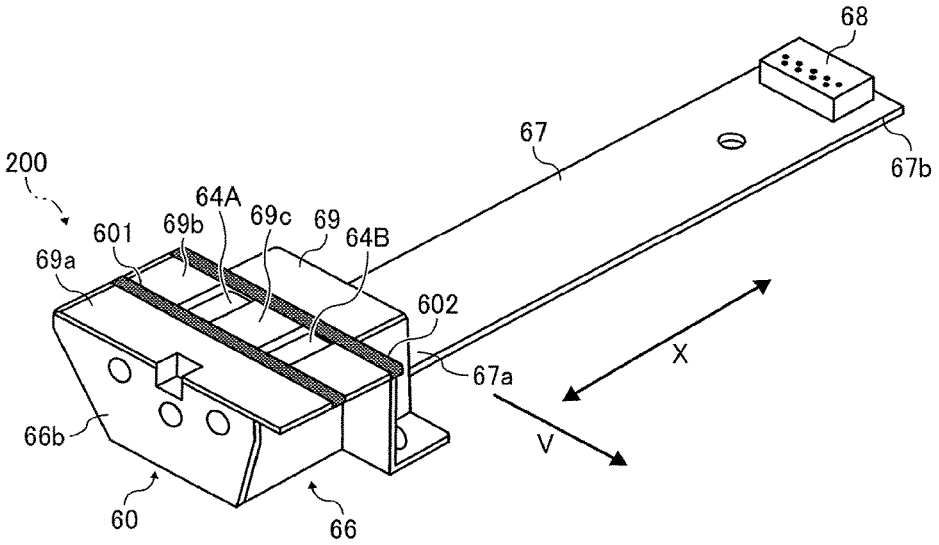
FIGS. 10A and 10B are perspective views respectively illustrating a configuration of the optical detector according to the exemplary embodiment and a configuration of a pressing member and the optical detector according to the exemplary embodiment.
Figure 10B:
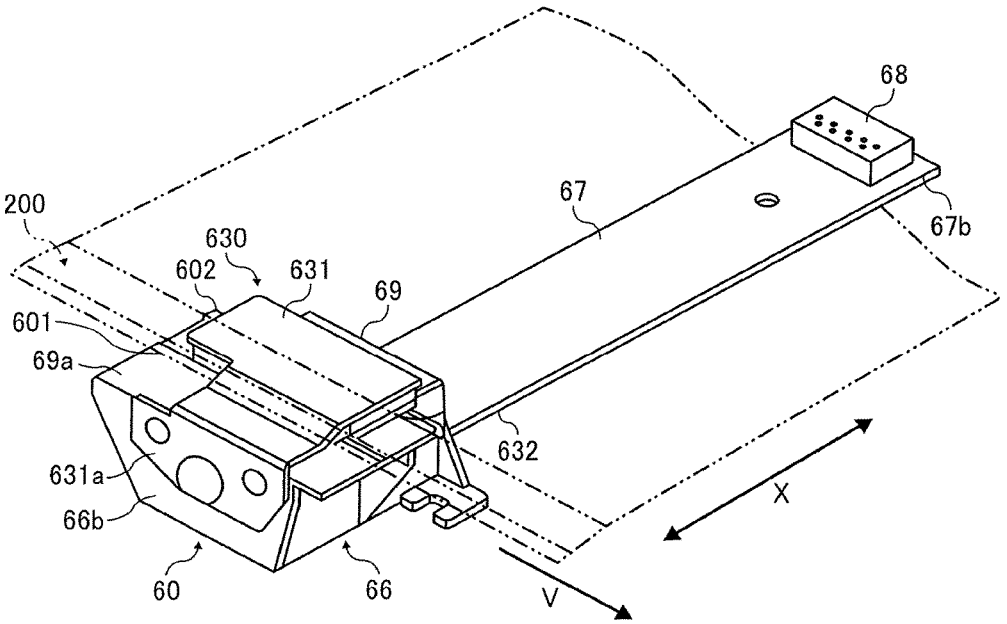

As illustrated in FIGS. 10B and 11, the transfer unit 500 according to the exemplary embodiment includes a pressing member 630 that presses the transfer belt 10 against the guide rails 601 and 602. The pressing member 630 is disposed on a surface 10*c* of the transfer belt 10, the surface 10*c* being provided on the side opposite the scale sensors 60A and 60B (the optical detector 60) and the scale tape 200 via the transfer belt 10. As illustrated in FIG. 11, the pressing member 630 includes a supporting plate 631 made of metal, and a pressing member 632 that contacts the surface 10*c* of the transfer belt 10. The supporting plate 631 is L-shaped in cross section, and includes a first end area 631*a* and a second end area 631*b*. The supporting plate 631 is formed such that the second end area 631*b* is positioned higher than the surface 10*c* of the transfer belt 10 when the first end area 631*a* is attached to a side surface 66*b* of the casing 66 of the optical detector 60. On the side near the second end area 631*b* of the supporting plate 631, the pressing member 632 projects toward the surface 10*c* from an inner surface 631*c* disposed opposite the surface 10*c* of the transfer belt 10 such that the pressing member 632 presses the entire area of the guide rails 601 and 602 via the transfer belt 10. The pressing member 632 has a multi-layer structure, and includes a sponge layer 633 as a foam, a resin layer 634, and a protective layer 635 that are laminated. The pressing member 632 is attached to the inner surface 631*c* of the supporting plate 631. The supporting plate 631 has a function of applying a pressing force to the transfer belt 10 by elastic deformation of the pressing member 632 when the pressing member 632 contacts the surface 10*c* of the transfer belt 10, preferably when the pressing member 632 presses the surface 10*c* of the transfer belt 10. The resin layer 634 is, for example, a thin film such as a Mylar film (e.g., the thin film is made of polyethylene terephthalate and has a thickness of approximately 200 μm), and has a function of maintaining a shape of the pressing member 632. The protective layer 635 includes, for example, felt, and forms a contact area with the surface 10*c* of the transfer belt 10. The protective layer 635 has a function of preventing damage to the surface 10*c* even if contacting the surface 10*c* of the transfer belt 10.

According to the exemplary embodiment, since the pressing member 630 for pressing the guide rails 601 and 602 via the transfer belt 10 is disposed, the transfer belt 10 is grasped by the pressing member 632 of the pressing member 630 and the guide rails 601 and 602 from a vertical direction. Hence, a vertical vibration of the transfer belt 10 can be suppressed, and a relative position of the windows 64A and 64B and the scale tape 200 (the guide surface 69*a* and the inner surface 10B of the transfer belt 10) can be stabilized, thereby preventing the adherents T from falling.

In the exemplary embodiment, the guide rails 601 and 602 as the regulation members and the bracket 69 are individually formed and then integrated. However, the bracket 69 may be integrally molded on the guide surface 69*a* molded of a resin material, and then disposed on the both sides in the width direction of the windows 64A and 64B as openings. Such integration molding can eliminate a process for preparing a groove on the guide surface 69*a* and a process for attaching the guide rails 601 and 602 to the guide surface 69*a*. According to the exemplary embodiment, on the other hand, when the guide rails 601 and 602 formed separately from the bracket 69 are attached to the guide surface 69*a*, a material that is different from a material for the bracket 69 can be selected for the guide rails 601 and 602. Therefore, the material can be selected in consideration of contact resistance to the inner surface 10B of the transfer belt 10. Such selection can enhance design flexibility. Moreover, the material selection can not only be useful for control of fluctuations in speed of the transfer belt, but also stabilize a machine configuration. For the attachment of the guide rails 601 and 602 to the bracket 69, end portions on an upstream side of the respective guide rails 601 and 602 in a conveyance direction are connected to form a portion 603 having a snap-fit shape in the connected area, whereas end portions on a downstream side of the respective guide rails 601 and 602 in a conveyance direction are connected to form a portion 604 having a snap-fit shape in the connected area. Moreover, insertion portions 605 and 606 are formed on the guide surface 69*a* of the bracket 69. The snap-fit-shaped portions 603 and 604 are respectively inserted into and hung on the insertion portions 605 and 606. Alternatively, the snap-fit-shaped portions 603 and 604 can be respectively inserted into the insertion portions 605 and 606, and then the guide rails 601 and 602 can be attached to the bracket 69. In such a case, assemblability of the guide rails 601 and 602 with the bracket 69 can be enhanced.

Figure 14A:
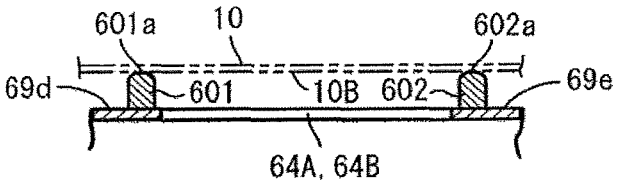
FIGS. 14A and 14B are enlarged views respectively illustrating a sectional shape of a regulation member of the exemplary embodiment, and a sectional shape of a modification example of the regulation member.
Figure 14B:
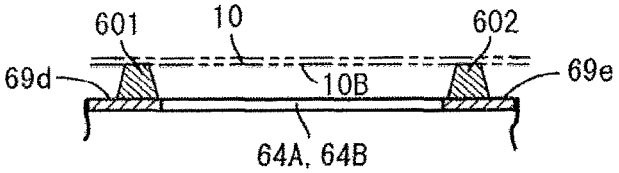

In the exemplary embodiment, the guide rails 601 and 602 respectively include end portions 601*a* and 602*a* that contact the inner surface 10B of the transfer belt 10 and have an arc shape in cross section as illustrated in FIG. 14A. However, the shape of the guide rails 601 and 602 is not limited to the arc shape. For example, the guide rails 601 and 602 may be trapezoidal in cross section as illustrated in FIG. 14B.

Figure 15:
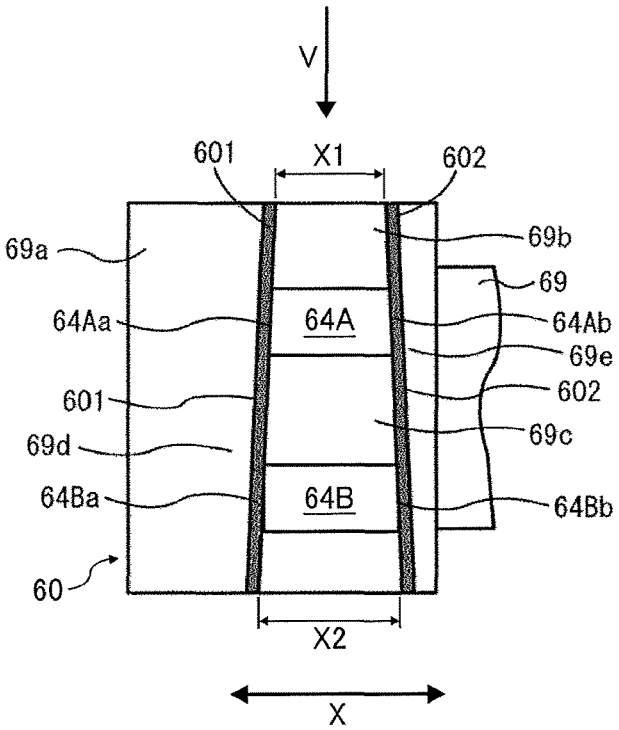
FIG. 15 is a plan view illustrating other arrangement of the regulation member.
Figure 16:
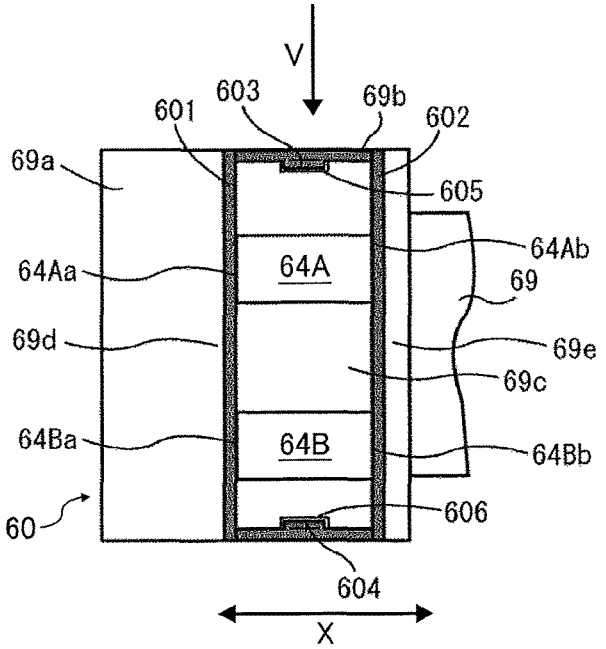
FIG. 16 is a plan view illustrating attachment of the regulation member to the optical detector.

In the exemplary embodiment, the guide rails 601 and 602 are arranged parallel to each other in the belt movement direction V. However, arrangement of the guide rails 601 and 602 is not limited to the parallel arrangement in the belt movement direction V. For example, as illustrated in FIG. 15, the guide rails 601 and 602 can be arranged in a non-parallel manner such that a width X2 is wider than a width X1, where the width X2 is a width between the guide rails 601 and 602 in a width direction on a downstream side in the belt movement direction V, and the width X1 is a width between the guide rails 601 and 602 in the width direction on an upstream side in the belt movement direction V. That is, the guide rails 601 and 602 are arranged on the guide surface 69*a* such that the width X1 between the guide rails 601 and 602 on the upstream side in the belt movement direction V is narrower than the width X2 between the guide rails 601 and 602 on the downstream side in the belt movement direction V. The guide rails 601 and 602 are preferably arranged in such a manner since the width on a side from which the adherents T adhering to the transfer belt 10 enter the windows 64A and 64B can be reduced. Such reduction can further reduce an amount of the adherents T adhering to the windows 64A and 64B due to fall of the adherents T. In the exemplary embodiment, the guide rails 601 and 602 are respectively arranged in the portions 69*d* and 69*e* of the guide surface 69*a*, the portions 69*d* and 69*e* being positioned on both sides in the width direction of the windows 64A and 64B. However, even if the guide rail 601 or 602 is disposed at least in the portion 69*d* or 69*e* of the guide surface 69*a* on one side in the width direction of the windows 64A and 64B, the effects of the exemplary embodiment can be obtained.

The present disclosure has been described above with reference to specific exemplary embodiments but is not limited thereto. Various modifications and enhancements are possible without departing from scope of the disclosure. For example, in the exemplary embodiment, an electrophotographic color copier 1000 forming an image with toner is described as an image forming apparatus. However, the belt device according to the exemplary embodiment can be applied to an image forming apparatus that forms an image with ink. In such a case, paper powder adhering to a scale tape 200 of a transfer belt 10 can be prevented from falling. Moreover, the present disclosure has been described above with reference to preferable effects but is not limited thereto.

It is therefore to be understood that the present disclosure may be practiced otherwise than as specifically described herein. For example, elements and/or features of different illustrative exemplary embodiments may be combined with each other and/or substituted for each other within the scope of the present disclosure.

What is claimed is:

1. A belt device comprising:

a belt movable in a direction of belt movement;

a detected unit disposed on at least one side of the belt in a width direction of the belt intersecting with the direction of belt movement and extending in the direction of belt movement;

a window to transmit detection light emitted toward the detected unit and reflected light from the detected unit;

an optical detector to detect the detected unit; and a regulation member, disposed on at least one side in a width direction of the window, to keep the detected unit away from the window, wherein the optical detector includes a bracket having the window, and wherein the regulation member is integrally molded with the bracket.

2. The belt device according to claim 1, wherein the bracket includes a guide surface on an upstream side of the window in the direction of belt movement, and wherein the window is recessed away from the detected unit relative to the guide surface.

3. The belt device according to claim 2, wherein:

the regulation member projects toward the detected unit relative to the guide surface.

4. The belt device according to claim 3 wherein the regulation member is a guide rail disposed extending in the direction of belt movement.

5. The belt device according to claim 4 wherein the guide rail is configured to extend along an entire area of the guide surface in the direction of belt movement.

6. The belt device according to claim 1, wherein the bracket includes a guide surface on an upstream side of the window in the direction of belt movement, and wherein the regulation member projects toward the detected unit relative to the guide surface.

7. The belt device according to claim 6 wherein the regulation member is a guide rail disposed extending in the direction of belt movement.

8. The belt device according to claim 7 wherein the guide rail is configured to extend along an entire area of the guide surface in the direction of belt movement.

9. The belt device according to claim 1, wherein the detected unit includes a plurality of marks disposed along the direction of belt movement and having predetermined pitch between marks adjacent to each other.

10. The belt device according to claim 1, further comprising a pressing member, disposed on a side opposite the optical detector via the belt member, to press the belt against the regulation member.

11. The belt device according to claim 1, further comprising a plurality of supporting members around which the belt is looped, wherein one of the plurality of supporting members is a tension application rotator to apply tension to the belt member.

12. An image forming apparatus comprising the belt device according to claim 1.

13. A belt device comprising:

a belt movable in a direction of belt movement;

a detected unit disposed on at least one side of the belt in a width direction of the belt intersecting with the direction of belt movement and extending in the direction of belt movement;

a window to transmit detection light emitted toward the detected unit and reflected light from the detected unit;

an optical detector to detect the detected unit; and a regulation member, disposed on at least one side in a width direction of the window, to keep the detected unit away from the window, wherein the optical detector includes a bracket having the window, and wherein the regulation member is disposed on the bracket.

14. The belt device according to claim 13, wherein the bracket includes a guide surface on an upstream side of the window in the direction of belt movement, and wherein the window is recessed away from the detected unit relative to the guide surface.

15. The belt device according to claim 14, wherein the regulation member projects toward the detected unit relative to the guide surface.

16. The belt device according to claim 15, wherein the regulation member is a guide rail disposed extending in the direction of belt movement.

17. The belt device according to claim 13, wherein the bracket includes a guide surface on an upstream side of the window in the direction of belt movement, and wherein the regulation member projects toward the detected unit relative to the guide surface.

18. The belt device according to claim 17, wherein the regulation member is a guide rail disposed extending in the direction of belt movement.

19. The belt device according to claim 18, wherein the guide rail is configured to extend along an entire area of the guide surface in the direction of belt movement.

20. An image forming apparatus comprising the belt device according to claim 13.

* * * * *